US009903073B2

(12) United States Patent
Fujimori et al.

(10) Patent No.: US 9,903,073 B2
(45) Date of Patent: Feb. 27, 2018

(54) COLORED ARAMID PAPER AND PROCESS FOR PRODUCING SAME

(71) Applicant: DUPONT TEIJIN ADVANCED PAPERS (JAPAN), LTD., Tokyo (JP)

(72) Inventors: Tatsushi Fujimori, Tokyo (JP); Shinji Naruse, Tokyo (JP); Chihiro Kondo, Tokyo (JP)

(73) Assignee: DUPONT TEIJIN ADVANCED PAPERS (JAPAN), LTD., Tokyo (JP)

( * ) Notice: Subject to any disclaimer, the term of this patent is extended or adjusted under 35 U.S.C. 154(b) by 0 days.

(21) Appl. No.: 14/766,480

(22) PCT Filed: Feb. 6, 2014

(86) PCT No.: PCT/JP2014/052771

§ 371 (c)(1),
(2) Date: Aug. 7, 2015

(87) PCT Pub. No.: WO2014/123191

PCT Pub. Date: Aug. 14, 2014

(65) Prior Publication Data

US 2015/0376837 A1 Dec. 31, 2015

(30) Foreign Application Priority Data

Feb. 8, 2013 (JP) ..... 2013-023522

(51) Int. Cl.

| | |
|---|---|
| ***D21H 21/28*** | (2006.01) |
| ***D21H 13/26*** | (2006.01) |
| ***D21H 19/10*** | (2006.01) |
| ***D21H 19/42*** | (2006.01) |
| ***H01B 3/52*** | (2006.01) |
| ***D21H 17/00*** | (2006.01) |
| *D21H 17/57* | (2006.01) |

(52) U.S. Cl.

CPC ..... *D21H 21/28* (2013.01); *D21H 13/26* (2013.01); *D21H 17/72* (2013.01); *D21H 19/10* (2013.01); *D21H 19/42* (2013.01); *H01B 3/52* (2013.01); *D21H 17/57* (2013.01)

(58) Field of Classification Search

CPC ..... D21H 13/26; D21H 21/28; D21H 13/10; D21H 13/20; D21H 13/24; D21H 17/57; D21H 17/72; D21H 19/10; H01B 3/52; H01B 7/292; H01B 7/295

See application file for complete search history.

(56) References Cited

U.S. PATENT DOCUMENTS

| | | | | | |
|---|---|---|---|---|---|
| 3,506,990 | A | | 4/1970 | Richardson | |
| 4,112,016 | A | | 9/1978 | Moulds | |
| 4,162,275 | A | | 7/1979 | Moulds | |
| 4,472,241 | A | * | 9/1984 | Provost | D21H 13/26 162/146 |
| 4,729,921 | A | * | 3/1988 | Tokarsky | D21H 13/26 162/146 |
| 5,026,456 | A | * | 6/1991 | Hesler | D21H 13/26 162/146 |
| 5,084,136 | A | * | 1/1992 | Haines | D04H 1/72 162/157.3 |
| 5,126,012 | A | * | 6/1992 | Hendren | D21H 13/26 162/146 |
| 5,171,402 | A | * | 12/1992 | Haines | D04H 1/72 162/157.3 |
| 5,759,348 | A | * | 6/1998 | Yamabayashi | C08G 59/1427 162/157.3 |
| 5,833,807 | A | * | 11/1998 | Ramachandran | D21H 13/26 162/146 |
| 5,965,072 | A | | 10/1999 | Hesler | |
| 5,998,309 | A | | 12/1999 | Hesler | |
| 6,942,757 | B1 | * | 9/2005 | Iwama | D21H 13/26 162/146 |
| 7,026,033 | B2 | * | 4/2006 | Fujimori | H05K 1/0366 162/146 |
| 7,455,750 | B2 | * | 11/2008 | Conley | D21H 13/26 162/157.3 |
| 7,927,461 | B2 | * | 4/2011 | Yokura | B32B 5/26 162/146 |
| 8,398,906 | B2 | * | 3/2013 | Hendriks | C08L 77/10 264/171.1 |

(Continued)

FOREIGN PATENT DOCUMENTS

| | | | | |
|---|---|---|---|---|
| CN | 1710196 | | 12/2005 | |
| CN | 101180435 | | 5/2008 | |
| CN | 101198657 | | 6/2008 | |
| EP | 1873307 | A2 * | 1/2008 | B32B 5/26 |
| EP | 2492392 | A1 * | 8/2012 | D21F 1/0018 |
| GB | 1 438 067 | | 6/1976 | |
| JP | 44-11168 | | 5/1969 | |
| JP | 0995870 | | 4/1997 | |
| JP | 2001303479 | | 10/2001 | |

(Continued)

OTHER PUBLICATIONS

International Search Report dated May 13, 2014 in corresponding International Application No. PCT/JP2014/052771 (with English translation).

(Continued)

*Primary Examiner* — Jose A Fortuna

(74) *Attorney, Agent, or Firm* — Wenderoth, Lind & Ponack, L.L.P.

(57) ABSTRACT

Disclosed is colored aramid paper which comprises aramid paper comprising aramid fibrids and short aramid fibers and, formed on at least one surface thereof, a colored layer comprising a colorant and a binder, wherein the colored layer has a surface resistivity of $1\times10^{12}\Omega/\square$ or higher and the colored layer comprises portions colored in a single hue, the colored portions having a color difference of 5.0 or less.

13 Claims, No Drawings

(56) References Cited

U.S. PATENT DOCUMENTS 8,747,614 B2 * 6/2014 Fujimori ..... D21H 13/26 162/138
2004/0089432 A1 * 5/2004 Levit ..... C08J 5/04 162/157.3
2004/0180185 A1 * 9/2004 Fujimori ..... H05K 1/0366 428/297.4
2005/0230072 A1 * 10/2005 Levit ..... D21H 13/26 162/146
2006/0266486 A1 * 11/2006 Levit ..... D21H 13/26 162/146
2007/0167101 A1 * 7/2007 Naruse ..... D21H 13/26 442/414
2008/0000599 A1 * 1/2008 Yokura ..... B32B 5/26 162/146
2009/0029885 A1 * 1/2009 Conley ..... D21H 13/26 508/258
2009/0049625 A1 * 2/2009 Miyamoto ..... C09B 67/0063 8/637.1
2009/0159226 A1 * 6/2009 Levit ..... D21H 13/10 162/146
2009/0159227 A1 * 6/2009 Levit ..... D21H 13/10 162/146
2010/0206502 A1 * 8/2010 Levit ..... D21H 13/26 162/157.3
2010/0212851 A1 * 8/2010 Levit ..... C09K 3/1028 162/157.3
2011/0297305 A1 12/2011 Miyamoto et al.
2013/0277089 A1 * 10/2013 Rolink ..... C08J 5/06 174/110 R
2014/0034256 A1 * 2/2014 Fujimori ..... D21H 13/26 162/138
2015/0111013 A1 * 4/2015 Fujimori ..... B32B 27/16 428/212
2015/0318078 A1 * 11/2015 Rolink ..... D21H 5/20 162/138
2015/0376837 A1 * 12/2015 Fujimori ..... D21H 21/28 162/126

FOREIGN PATENT DOCUMENTS

JP 2002-508041 3/2002
JP 2009077124 4/2009
WO WO 9323620 A1 * 11/1993 ..... D21H 13/26
WO 2005/100688 10/2005
WO WO 2005103376 A1 * 11/2005 ..... D21H 13/26
WO WO 2012137631 A1 * 10/2012 ..... D21H 13/26
WO WO 2013024862 A1 * 2/2013 ..... D21H 13/26
WO WO 2014109203 A1 * 7/2014 ..... D21B 1/32
WO WO 2014123191 A1 * 8/2014 ..... D21H 21/28
WO WO 2015033697 A1 * 3/2015 ..... H05K 9/0088

OTHER PUBLICATIONS

Official Action dated Jun. 14, 2016 in Chinese patent application No. 201480007988.2.

* cited by examiner

COLORED ARAMID PAPER AND PROCESS FOR PRODUCING SAME

TECHNICAL FIELD

The present invention relates to a colored aramid paper excellent in heat resistance, electrical characteristics, and the like, and a process for producing the colored aramid paper. In particular, the present invention relates to a colored aramid paper useful as an insulating material for rotating machines, transformers, and electrical and electronic equipment, and the like, and a process for producing the colored aramid paper.

BACKGROUND ART

Conventionally, formed articles made of heat resistant polymers have been used in an electrical insulation field where heat resistance is required. Especially, formed articles using aromatic polyamides (hereinafter, referred to as aramids) are excellent industrial materials having heat resistance, chemical resistance, and flame retardancy attributable to the molecular structures of the aramids. In particular, a paper (product name: NOMEX (registered trademark)) made of a fibrid and a fiber of poly(meta-phenylene isophthalamide) (hereinafter referred to as meta-aramid) has been widely used as an electrically insulating paper excellent in heat resistance.

In general, almost all formed articles using meta-aramid are colored in white, and the above-described meta-aramid paper is also white or transparent white. Meanwhile, the meta-aramid paper is used in electrical insulation applications, for example, in such a manner that the meta-aramid paper is shaped into tape with a narrow width, and wound around an electric conductor, or that the meta-aramid paper is cut into a predetermined shape, and if necessary, shaped, and then inserted or fitted along the shape of an electric conductor, a casing, or the like. However, the meta-aramid paper has the following problems and the like. Specifically, for example, when multiple lead wires around which the meta-aramid paper is wound are bundled together and used as an electric cable, the appearances of all the lead wires are the same, and it is hence difficult to determine which lead wire is to be connected. In addition, when the meta-aramid paper is used after being attached to or fitted into a casing of a similar color or the like, it is difficult to find out whether an insulating paper is integrated. As a solution to these problems, there has been a demand for a colored aramid paper.

Processes for producing a colored aramid paper can be roughly classified into processes in which a meta-aramid fiber and a meta-aramid fibrid serving as raw materials are colored in advance, and a sheet is formed therefrom, and processes in which an aramid paper is colored after its production.

Many methods have been proposed for coloring a meta-aramid fiber. Examples of disclosed methods include a method in which a dope is dyed with a pigment (for example, UK Patent No. GB1438067), a method in which a meta-aramid fiber is dyed by using a cationic dye (for example, Japanese Patent Application Publication No. Hei 09-95870), a method in which a functional group is introduced into a meta-aramid fiber to improve the dyeing properties, and then the meta-aramid fiber is dyed by using a cationic dye (for example, Japanese Examined Patent Application Publications No. Sho 44-11168), and the like. It is conceivable that a meta-aramid fibrid can be colored by using a similar method. However, the dope-dyeing has problems such as the limitations on the range of hue, and increase in production costs because of the use of the pigment in raw material production, which requires cleaning of a line and the like. In addition, the meta-aramid fiber has lower dyeing properties than fibers which are used for clothing and to which the dyeing process is applied in general, such as, for example, polyester fibers, acrylic fibers, and rayon fibers. Hence, the range of hue is limited also for this reason. In addition, there is a concern over such problems that since the fiber and the fibrid are different in dyeing properties, non-uniformity in color tends to be caused when a sheet is formed from them, and that because of exposure to high-temperature wet heat, a sheet formed from them has decreased mechanical strength.

In addition, a method may be employed in which an aramid paper is dyed after its production. However, this method has such problems that the difference in dyeing properties between the fiber and the fibrid tends to cause non-uniformity in color as described above, and the wet heat treatment tends to cause wrinkles, and lowers the mechanical strength.

Note that generally used aramid papers are calendered at high temperature, and few functional groups are present on the surface of the aramid itself. For these reasons and the like, aramid papers have such a problem that the aramid papers are more resistant to penetration of a coloring liquid, and hence are more difficult to color uniformly than pulp fiber papers.

SUMMARY OF INVENTION

An object of the present invention is to provide a colored aramid paper excellent in heat resistance, electrical characteristics, and the like and a process for producing the colored aramid paper, especially a colored aramid paper useful as an insulating material for rotating machines, transformers, and electrical and electronic equipment, and the like, and a process for producing the colored aramid paper.

In view of such circumstances, the present inventors have conducted intensive study to develop a colored aramid paper excellent in heat resistance, electrical characteristics, and the like, and consequently have completed the present invention.

Specifically, a first invention of the present application provides an aramid paper comprising:

an aramid paper comprising an aramid fibrid and an aramid short fiber; and a colored layer provided on at least one surface of the aramid paper and comprising a coloring agent and a binder, wherein the colored layer has a surface resistivity of $1\times10^{12}\Omega/\square$ or higher, and a color difference in a colored portion colored in a single hue in the colored layer is 5.0 or less.

A second invention of the present application provides the colored aramid paper according to the first invention, wherein the colored layer is colored in a single hue or two or more hues.

A third invention of the present application provides the colored aramid paper according to the first or second invention, wherein the colored layer has a thickness of 0.01 to 10 μm.

A fourth invention of the present application provides the colored aramid paper according to any one of the first to third inventions, wherein the colored aramid paper has a thickness of 0.02 to 1.00 mm.

A fifth invention of the present application provides the colored aramid paper according to any one of the first to fourth inventions, wherein the coloring agent is an organic pigment or an inorganic pigment.

A sixth invention of the present application provides a process for producing a colored aramid paper, the process comprising applying a coating liquid comprising a coloring agent, a binder, and 10 to 98 wt % of an organic solvent onto at least one surface of an aramid paper comprising an aramid fibrid and an aramid short fiber to form a colored layer.

A seventh invention of the present application provides the process for producing an aramid paper according to the sixth invention, which is the process for producing a colored aramid paper, wherein the content of the coloring agent in the coating liquid is 1 to 30 wt %, and the content of the binder in the coating liquid is 1 to 20 wt %.

An eighth invention of the present application provides the process for producing an aramid paper according to the sixth or seventh invention, wherein the organic solvent comprises at least one of alcohols, esters, ethers, ketones, and aromatic hydrocarbons.

Hereinafter, the present invention will be described in detail.

DESCRIPTION OF EMBODIMENTS (Aramid)

In the present invention, an aramid means a linear polymeric compound in which 60% or more of amide linkages are directly bonded to aromatic rings. Examples of such an aramid include poly(meta-phenylene isophthalamide), copolymers thereof, poly(para-phenylene terephthalamide), copolymers thereof, copoly(para-phenylene-3,4'-diphenyl ether terephthalamide), and the like. These aramids are industrially produced, for example, based on a condensation reaction between an aromatic acid dichloride and an aromatic diamine(s) by a solution polymerization method, a two-step interfacial polymerization method, or the like, and are available as commercial products. However, the aramids are not limited thereto. Of these aramids, poly(meta-phenylene isophthalamide) is preferably used, because it has excellent characteristics such as formability, flame retardancy, and heat resistance.

(Aramid Fibrid)

In the present invention, an aramid fibrid is film-like fine particles made of an aramid, and may also be referred to as an aramid pulp. Examples of processes for producing an aramid fibrid include those described in Japanese Examined Patent Application Publications Nos. Sho 35-11851 and Sho 37-5732, and the like. The aramid fibrid has a property of being formed into paper as in the case of ordinary wood pulp. Hence, after being dispersed in water, the aramid fibrid can be formed into a sheet-like shape with a paper machine. In this case, a so-called beating/refining treatment can be conducted in order to keep qualities suitable for paper making. This beating/refining treatment can be conducted with a disk refiner, a beater, or other devices having a mechanical cutting effect for treating paper-making raw materials. In this operation, the change in the form of the fibrid can be, monitored based on the freeness specified in JIS P 8121. In the present invention, the freeness of the aramid fibrid subjected to the beating/refining treatment is preferably in a range from 10 to 300 $cm^3$ (Canadian standard freeness). A fibrid having a freeness above this range may lead to decrease in strength of a sheet formed from the fibrid. On the other hand, when an attempt is made to obtain a freeness below 10 $cm^3$, the efficiency of utilization of the inputted mechanical power is lowered, and the amount of treatment per unit time decreases in many cases. Moreover, the fibrid becomes excessively fine, so that the so-called binder function tends to decrease. Hence, no significant advantage is seen by obtaining a freeness smaller than 10 $cm^3$.

(Aramid Short Fiber)

In the present invention, an aramid short fiber is one obtained by cutting a fiber made of an aramid into pieces having predetermined lengths. Examples of such a fiber include "CONEX (registered trademark)" and "Technora (registered trademark)" of Teijin Limited, "NOMEX (registered trademark)" and "Kevlar (registered trademark)" of DuPont, "Twaron (registered trademark)" of Teijin Aramid BV, and the like, but are not limited thereto.

The aramid short fiber can preferably have a fineness in a range from 0.05 dtex inclusive to 25 dtex exclusive. A fiber having a fineness of less than 0.05 dtex is not preferable, because aggregation tends to occur during the production by a wet method (described later). Meanwhile, a fiber having a fineness of 25 dtex or more is not preferable, because such a fiber has an excessively large fiber diameter, which may cause decrease in aspect ratio, reduction of the mechanical reinforcing effect, and poor uniformity of the aramid paper.

The length of the aramid short fiber can be selected in a range from 1 mm inclusive to 25 mm exclusive, and preferably from 2 to 12 mm. If the length of the short fiber is less than 1 mm, mechanical characteristics of the aramid paper deteriorate. On the other hand, an aramid short fiber having a length of 25 mm or more tends to undergo "entanglement", "bundling", and the like during production of the aramid paper by a wet method described later, and hence tends to cause defects. Therefore, such lengths are not preferable.

(Aramid Paper)

In the present invention, an aramid paper is a sheet-like article mainly made of the above-described aramid fibrid and aramid short fiber, and has a thickness in a range from 20 μm to 1000 μm, in general. In addition, the aramid paper has a basis weight in a range from 10 $g/m^2$ to 1000 $g/m^2$, in general. Here, the aramid fibrid and the aramid short fiber may be mixed at any ratio, and the aramid fibrid/aramid short fiber ratio (mass ratio) is preferably 1/9 to 9/1, and more preferably 2/8 to 8/2. However, the ratio is not limited to this range.

The aramid paper is generally produced by a method in which the above-described aramid fibrid and aramid short fiber are mixed with each other, and then a sheet is formed therefrom. Specific examples of employable methods include a method in which the aramid fibrid and the aramid short fiber are dry blended with each other, and then a sheet is formed by using an air stream; a method in which the aramid fibrid and the aramid short fiber are dispersed in a liquid medium and mixed with each other, then a sheet is formed by discharging the dispersion onto a liquid permeable support such as a wire or a belt, and the liquid is removed from the sheet, which is then dried; and the like. Of these methods, the so-called wet paper making method is preferably selected in which water is used as the medium.

In the wet paper making method, aqueous slurries of at least the aramid fibrid and the aramid short fiber or an aqueous slurry of a mixture thereof is fed to a paper machine and dispersed, followed by water-draining, water-squeezing, and drying operations, and then the paper is wound as a sheet, in general. As the paper machine, a Fourdrinier paper machine, a cylinder paper machine, an inclined-type paper machine, combination paper machine in which any of these paper machines are combined, or the like is used. In the case of production using a combination paper machine, it is possible to obtain a composite sheet comprising multiple paper layers by forming sheets from slurries having different blending ratios and integrating these sheets together. If necessary, additives such as a dispersibility improver, a defoamer, and a strengthening agent are used in the paper making.

The density and mechanical strength of the aramid paper obtained as described above can be improved by hot-pressing the aramid paper between a pair of rolls at high temperature and high pressure. For example, when metal rolls are used, the hot-pressing conditions are, for example, that the temperature is in a range from 10 to 350° C. and the linear pressure is in a range from 50 to 400 kg/cm, but are not limited thereto. It is also possible to laminate multiple aramid papers during the hot-pressing. The above-described hot-pressing may be conducted multiple times in any order.

(Coloring Agent)

Coloring agents used in the present invention include ordinary dyes, inorganic pigments, and organic pigments. Of these coloring agents, inorganic pigments and organic pigments are particularly preferable. The inorganic pigments include chrome yellow, zinc yellow, Prussian blue, barium sulfate, cadmium red, titanium oxide, zinc white, red iron oxide, alumina white, calcium carbonate, ultramarine, carbon black, graphite, aluminum powder, and the like. The organic pigments include azo pigments including soluble azo pigments such as C-type naphthol-based) and 2B- and 6B-type (β-oxynaphthoic-based) soluble azo pigments, insoluble azo pigments such as β-naphthol-based, β-oxynaphthoic anilide-based, monoazo yellow-based, disazo yellow-based, and pyrazolone-based insoluble azo pigments, condensed azo pigments such as acetoacetanilide-based condensed azo pigments, phthalocyanine pigments including copper phthalocyanines (α-blue, β-blue, and ϵ-blue), halogenated copper phthalocyanines such as chlorinated or brominated copper phthalocyanines, and metal-free phthalocyanine pigments, and polycyclic pigments including perylene-based, perinone-based, quinacridone-based, thioindigo-based, dioxazine-based, isoindolinone-based, and quinophthalone-based pigments. The amount of the coloring agent added is preferably 1 to 30 wt %, and more preferably 2 to 25 wt %, relative to the total amount of the coating liquid.

(Binder)

In the present invention, a binder is used for adhering and immobilizing the coloring agent onto a substrate made of an aramid paper to form a colored layer. Examples of binders used in the present invention include, but are not limited to, vinyl chloride resins, vinyl acetate resins, acrylic resins, polyamide resins, polyester resins, urethane resins, cellulose resins, epoxy resins, phenolic resins, petroleum resin, copolymers thereof, and the like. One of these binders can be used alone, or two or more thereof may be used in combination. To take advantage of the heat resistance characteristic of an aramid paper, it is also possible to use a polyimide resin, a bismaleimide triazine resin, a silicon-based resin, a fluororesin, or an inorganic binder such as colloidal silica alone or as a mixture with other resins. The amount of the binder added is preferably 1 to 20 wt %, and more preferably 2 to 15 wt %, relative to the total amount of the coating liquid.

(Coating Liquid)

In the present invention, a coating liquid is a liquid used for forming a colored layer on a substrate made of an aramid paper by printing or coating described later, and contains a coloring agent, a binder, an auxiliary agent, water, and an organic solvent.

As the auxiliary agent used in the coating liquid, a dispersant, a stabilizer, an antioxidant, an antistat, a curing agent, a viscosity improver, a wear-resistance improver, and the like can be added, but the auxiliary agent is not limited to these agents. There is no specific limitation on the selection of the auxiliary agent, and it is possible to select a suitable auxiliary agent according to the types of the coloring agent and the binder within the range, unless an object of the present invention is impaired. The amount of the auxiliary agent added is preferably 0 to 10 wt % relative to the total amount of the coating liquid.

An aramid paper has a low affinity for water. Especially when water is dropped on a surface of a calendered aramid paper, the water does not penetrate into the aramid paper at all. Hence, it is necessary to use an organic solvent in the coating liquid of the present invention in order to uniformly color the substrate made of the aramid paper. Specifically, it is important that the coating liquid should contain at least one of alcohols such as methanol, ethanol, butanol, IPA (isopropyl alcohol), normal propyl alcohol, and butanol, esters such as ethyl acetate, methyl acetate, butyl acetate, and ethyl lactate, ethers such as isopropyl ether, methyl cellosolve, butyl Cellosolve, and dioxane, ketones such as acetone, methyl ethyl ketone, methyl isobutyl ketone, and diisobutyl ketone, and aromatic hydrocarbons such as toluene and xylene. The content of the organic solvent is preferably 10 to 98 wt %, more preferably 15 to 90 wt %, and further preferably 20 to 80 wt %, relative to the total amount of the coating liquid.

(Colored Aramid Paper)

In the present invention, a colored aramid paper is an aramid paper in which a colored layer comprising a coloring agent and a binder is formed on at least one surface of the above-described aramid paper. In general, the thickness of the colored aramid paper is preferably 0.02 to 1.00 mm, more preferably 0.03 to 0.85 mm, and further preferably 0.04 to 0.80 mm. Meanwhile, the thickness of the colored layer is preferably 0.01 to 20 μm, more preferably 0.05 to 15 μm, and further preferably 0.1 to 10 μm. A thickness of the colored layer less than 0.01 μm is not preferable, because it is difficult to form a uniformly colored layer. In addition, a thickness of the colored layer exceeding 20 μm is not preferable, because the flexibility and mechanical characteristics intrinsic to the paper may be impaired.

The surface resistivity of the colored layer of the colored aramid paper has to be $1\times10^{12}\Omega/\square$ or higher, and is preferably $5\times10^{12}\Omega/\square$ or higher, and more preferably $1\times10^{13}\Omega/\square$ or higher. A surface resistivity of less than $1\times10^{12}\Omega/\square$ is not preferable, because it is difficult to use the colored aramid paper in the electrical insulation applications. In this respect, to obtain a colored aramid paper having a surface resistivity falling within the range of the present invention, it is necessary to select a coloring agent having high electrical insulation properties. In addition, the surface resistivity of the colored layer is preferably $1\times10^{19}\Omega/\square$ or less.

In the colored aramid paper of the present invention, it is only necessary that the colored layer should be formed on at least one surface of the aramid paper comprising the aramid fibrid and the aramid short fiber, but the colored layer may be formed on each of the top and bottom surfaces of the aramid paper. However, from the viewpoint of productivity, it is preferable to form the colored layer on only one surface of the aramid paper, if the conditions of use permit.

As for a process for producing a colored aramid paper of the present invention, the colored aramid paper can be produced by forming a colored layer by either a printing method or a coating method using the above-described coating liquid. As the printing method, a conventionally known printing method such as offset printing, gravure printing, flexographic printing, letterpress printing, relief printing, screen printing, or on-demand printing can be employed without any particular limitation. Meanwhile, as the coating method, a conventionally known coating method such as roll coating, gravure coating, bar coating, die coating, or knife coating can be employed without any particular limitation. It is only necessary to select a printing technique or a coating technique suitable for the formation of the colored layer according to constituent materials of the coating liquid used. The hue of the colored layer of the colored aramid paper of the present invention is not particularly limited, and the colored layer may be formed in a single hue or in a combination of two or more hues. However, it is necessary that the color difference in a colored portion colored in a single hue in the colored layer should be 5.0 or less. The color difference is preferably 4.5 or less, and more preferably 4.0 or less. A color difference exceeding 5.0 is not preferable because of the following reason. Specifically, it is considered that the difference in hue is visually recognizable inmost cases where the color difference exceeds 5.0, and consequently may be regarded as non-uniformity in color.

Hereinafter, the present invention is described more specifically on the basis of Examples. Note that these Examples are provided for illustrative purposes only, and are not intended to limit contents of the present invention at all.

EXAMPLES (Measuring Methods)

(1) Mass Per Unit Area, Thickness, and Density

Measurements were conducted according to JIS C 2300-2, and the density was calculated by (mass per unit area/thickness). In addition, the thickness of the colored layer was calculated from the difference in thickness before and after the formation of the colored layer.

(2) Surface Resistivity and Volume Resistivity

Measurements were conducted according to ASTM D257 with an applied voltage of DC 500 V.

(3) Breakdown Voltage

The breakdown voltage was measured according to ASTM D149 by the short-time voltage rise method with an electrode diameter of 51 mm using an alternating current.

(4) Color Uniformity

The appearance of each colored layer was visually evaluated. A colored layer having uniform appearance was evaluated to be "○", a colored layer in which spot-like non-uniformity in color or an uncolored portion was slightly observed was evaluated to be "Δ", and a colored layer in which non-uniformity in color was clearly observed was evaluated to be "×".

(5) Color Difference

Measurement was conducted at randomly selected 10 points for colored layers evaluated to be ○ or Δ in the above-described item (4) and at randomly selected 5 points in each of the dark-colored portion and the light-colored portion for colored layers evaluated to be ×. Specifically, each sample was placed on 10 sheets of wood-free copier paper stacked together, and the color of each colored portion with a measurement diameter of 3 mm was measured by using a spectrophotometer ("CM-700d" manufactured by KONICA MINOLTA OPTICS, INC.). After the measurement of the color, the color difference (ΔE*ab) was calculated between every pair of the measurement points on the basis of JIS Z 8730, and a color difference with the highest numeric value among such color differences was employed as the color difference of the sample.

(6) Adhesion of Colored Layer

A pressure-sensitive adhesive tape ("CT-12" manufactured by Nichiban Co., Ltd.) was attached to the surface of an obtained colored layer, and adhered under pressure by using a pressure roller having a weight of 1 kg. Then, the pressure-sensitive adhesive tape was peeled away. After the peeling away, the pressure-sensitive adhesive tape was visually observed, and evaluation was made according to the following evaluation criteria.

○: The colored layer was not detached.

Δ: The colored layer was slightly attached to the tape.

x: The colored layer was attached to a half or more of the surface of the tape on which the colored layer was adhered under pressure.

Reference Example (Preparation of Raw Materials) A fibrid of poly(meta-phenylene isophthalamide) was produced by using a pulp particle production machine (wet sedimentation machine) including a combination of a stator and a rotor and described in Japanese Patent Application Publication No. Sho 52-15621. This fibrid was treated in a disintegrator and a beater/refiner to adjust the length-weighted mean fiber length to 0.9 mm. On the other hand, a meta-aramid fiber (NOMEX (registered trademark), single filament fineness: 2.2 dtex) manufactured by DuPont was cut into pieces having a length of 6 mm (hereinafter, referred to as "aramid short fiber") to prepare a raw material for paper making.

(Production of Calendered Aramid Paper)

Slurries were prepared by dispersing the aramid fibrid and aramid short fiber prepared as described above in water. These slurries were mixed with each other to achieve a blending ratio (weight ratio) of the aramid fibrid to the aramid short fiber of 1/1. The mixture was then fed to a Fourdrinier paper machine, and subjected to water-draining, water-squeezing, drying, and winding. In this manner, an aramid paper was obtained. Subsequently, this aramid paper was heated under pressure using metal calender rolls at a temperature of 330° C. and a linear pressure of 150 kg/cm to obtain a calendered aramid paper. Table 1 shows values of major characteristics of the thus obtained aramid paper.

TABLE 1

| characteristics | Unit | Ref. Ex. |
|---|---|---|
| Mass per unit area | $g/m^2$ | 40.0 |
| Thickness | μm | 59 |
| Density | $g/cm^3$ | 0.68 |
| Breakdown voltage | kV/mm | 16.5 |
| Surface resistivity | Ω/□ | $2.0 \times 10^{17}$ |
| Volume resistivity | Ωcm | $1.0 \times 10^{17}$ |

Example 1

A coating liquid was obtained by mixing 40 parts by weight of an aqueous pigment dispersion ("SA Blue XG"

manufactured by MIKUNI COLOR LTD., using phthalocyanine blue as a coloring agent) as an agent containing a coloring agent component, 22 parts by weight of an aqueous polyurethane resin ("HYDRAN AP-201" manufactured by DIC Corporation) as an agent containing a binder component, 20 parts by weight of ethanol, 10 parts by weight of isopropyl alcohol, and 8 parts by weight of water together, followed by stirring with a homomixer. Table 2 shows the blending ratio of the components, including the coloring agent, the binder, the organic solvents, and water, in the obtained coating liquid.

Next, a colored aramid paper was obtained by applying the coating liquid onto the calendered aramid paper by the gravure coating method using a gravure roll having a grid pattern with a cell volume of 18 $cm^3/m^2$, followed by drying at 80° C. for 10 seconds immediately thereafter, and further drying at 110° C. for 10 seconds. Table 3 shows values of major characteristics of the thus obtained colored aramid paper.

Example 2

A coating liquid and a colored aramid paper were obtained in the same manner as in Example 1, except that the ratio of ethanol was changed to 25 parts by weight, the ratio of isopropyl alcohol was changed to 15 parts by weight, and the ratio of water was changed to 0 parts by weight. Table 2 shows the blending ratio of the components, including the coloring agent, the binder, the organic solvents, and water, in the obtained coating liquid, and Table 3 shows values of major characteristics of the obtained colored aramid paper.

Example 3

A coating liquid and a colored aramid paper were obtained in the same manner as in Example 1, except that the ratio of ethanol was changed to 10 parts by weight, the ratio of isopropyl alcohol was changed to 5 parts by weight, and the ratio of water was changed to 23 parts by weight. Table 2 shows the blending ratio of the components, including the coloring agent, the binder, the organic solvents, and water, in the obtained coating liquid, and Table 3 shows values of major characteristics of the obtained colored aramid paper.

Comparative Example 1

A coating liquid and a colored aramid paper were obtained in the same manner as in Example 1, except that the ratio of ethanol was changed to 0 parts by weight, the ratio of isopropyl alcohol was changed to 0 parts by weight, and the ratio of water was changed to 38 parts by weight. Table 2 shows the blending ratio of the components, including the coloring agent, the binder, the organic solvents, and water, in the obtained coating liquid, and Table 3 shows values of major characteristics of the obtained colored aramid paper.

TABLE 2

| Blending ratio | Unit | Ex. 1 | Ex. 2 | Ex. 3 | Comp. Ex. 1 |
|---|---|---|---|---|---|
| Coloring agent | wt % | 10 | 10 | 10 | 10 |
| Binder | wt % | 5 | 5 | 5 | 5 |
| Water | wt % | 53 | 45 | 67 | 83 |
| Organic solvents | wt % | 30 | 38 | 15 | 0 |

TABLE 3

| Characteristics | Unit | Ex. 1 | Ex. 2 | Ex. 3 | Comp. Ex. 1 |
|---|---|---|---|---|---|
| Mass per unit area | $g/m^2$ | 41.1 | 41.1 | 41.0 | 41.0 |
| Thickness | μm | 60 | 60 | 60 | 61 |
| Density | $g/cm^3$ | 0.68 | 0.68 | 0.68 | 0.66 |
| Thickness of colored layer | μm | 1.1 | 1.1 | 1.3 | 1.8 |
| Breakdown voltage | kV/mm | 24.0 | 23.5 | 24.2 | 24.8 |
| Surface resistivity | Ω/□ | $8.5 \times 10^{15}$ | $9.1 \times 10^{15}$ | $4.5 \times 10^{15}$ | $3.0 \times 10^{15}$ |
| Volume resistivity | Ωcm | $1.2 \times 10^{16}$ | $1.2 \times 10^{16}$ | $9.6 \times 10^{15}$ | $7.1 \times 10^{15}$ |
| Color uniformity | | ○ | ○ | Δ | x |
| Color difference (ΔE*ab) | | 1.15 | 0.92 | 2.68 | 8.52 |
| Adhesion of colored layer | | ○ | ○ | ○ | Δ |
| Appearance (200° C. × 10 minutes) | | Unchanged | Unchanged | Unchanged | Unchanged |

The colored aramid papers obtained in Examples 1 to 3 are useful as insulating materials for rotating machines, transformers, electrical and electronic equipment, and the like, because the breakdown voltage was sufficiently high, and moreover because no change in appearance was observed even after the treatment at 200° C. for 10 minutes. In contrast, although the performances of the colored aramid paper of Comparative Example 1 as an insulating material were equivalent to those in Examples 1 to 3, streak-like non-uniformity in color was visually observed over the entire surface of the colored aramid paper of Comparative Example 1, and accordingly the color difference was high. Hence, the colored aramid paper of Comparative Example 1 seems inadequate as a colored aramid paper.

Example 4

A coating liquid was obtained by mixing 100 parts by weight of an ink ("JW252 AQUAECOL R39F" manufactured by TOYO INK CO., LTD.) containing a coloring agent component and a binder component, 3 parts by weight of an aqueous curing agent ("AQ LP HARDENER 1000" manufactured by TOYO INK CO., LTD.) as an agent containing an auxiliary agent component, 25 parts by weight of ethanol, 10 parts by weight of isopropyl alcohol, and 20 parts by weight of water together, followed by stirring with a homomixer. Table 4 shows the blending ratio of the components, including the coloring agent, the binder, the auxiliary agent, the organic solvents, and water, in the obtained coating liquid.

Next, a colored aramid paper was obtained by applying the coating liquid onto the calendered aramid paper by the gravure coating method using a gravure roll having a grid pattern with a cell volume of 18 $cm^3/m^2$, followed by drying at 80° C. for 10 seconds immediately thereafter, and further drying at 110° C. for 10 seconds. Table 5 shows values of major characteristics of the thus obtained colored aramid paper.

Example 5

A coating liquid and a colored aramid paper were obtained in the same manner as in Example 1, except that the ratio of ethanol was changed to 15 parts by weight, the ratio of isopropyl alcohol was changed to 5 parts by weight, and the ratio of water was changed to 35 parts by weight. Table 4 shows the blending ratio of the components, including the coloring agent, the binder, the auxiliary agent, the organic solvents, and water, in the obtained coating liquid, and Table 5 shows values of major characteristics of the obtained colored aramid paper.

Comparative Example 2

A coating liquid and a colored aramid paper were obtained in the same manner as in Example 1, except that the ratio of ethanol was changed to 0 parts by weight, the ratio of isopropyl alcohol was changed to 0 parts by weight, and the ratio of water was changed to 55 parts by weight. Table 4 shows the blending ratio of the components, including the coloring agent, the binder, the auxiliary agent, the organic solvents, and water, in the obtained coating liquid, and Table 5 shows values of major characteristics of the obtained colored aramid paper.

TABLE 4

| Blending ratio | Unit | Ex. 4 | Ex. 5 | Comp. Ex. 2 |
|---|---|---|---|---|
| Coloring agent | wt % | 10 | 10 | 10 |
| Binder | wt % | 10 | 10 | 10 |
| Auxiliary agent | wt % | 1 | 1 | 1 |
| Water | wt % | 52 | 60 | 73 |
| Organic solvents | wt % | 27 | 19 | 6 |

TABLE 5

| Characteristics | Unit | Ex. 4 | Ex. 5 | Comp. Ex. 2 |
|---|---|---|---|---|
| Mass per unit area | $g/m^2$ | 41.7 | 41.7 | 41.5 |
| Thickness | μm | 61 | 61 | 61 |
| Density | $g/cm^3$ | 0.69 | 0.69 | 0.68 |
| Thickness of colored layer | μm | 1.7 | 1.8 | 2.4 |
| Breakdown voltage | kV/mm | 20.7 | 20.2 | 19.1 |
| Surface resistivity | Ω/□ | $1.5 \times 10^{17}$ | $1.6 \times 10^{17}$ | $1.0 \times 10^{17}$ |
| Volume resistivity | Ωcm | $2.0 \times 10^{16}$ | $1.8 \times 10^{16}$ | $8.4 \times 10^{15}$ |
| Color uniformity | | ○ | ○ | x |
| Color difference (ΔE*ab) | | 0.85 | 0.92 | 17.37 |
| Adhesion of colored layer | | ○ | ○ | ○ |
| Appearance (200° C. × 10 minutes) | | Unchanged | Unchanged | Unchanged |

The colored aramid papers of Examples 4 and 5 are useful as insulating materials for rotating machines, transformers, electrical and electronic equipment, and the like, because the breakdown voltage was sufficiently high, and moreover because no change in appearance was observed even after the treatment at 200° C. for 10 minutes. In contrast, although the performances of the colored aramid paper of Comparative Example 2 as an insulating material were equivalent to those in Examples 4 and 5, some uncolored spots were observed on the colored aramid paper of Comparative Example 2. In addition, as in the case of Comparative Example 1, streak-like non-uniformity in color was visually observed over the entire surface of the paper, and accordingly the color difference was high. Hence, the colored aramid paper of Comparative Example 2 seems inadequate as a colored aramid paper.

The invention claimed is:

1. A colored aramid paper, comprising:

an aramid paper comprising an aramid fibrid and an aramid short fiber having a length of 1 mm to 25 mm; and a colored layer provided on at least one surface of the aramid paper and comprising a coloring agent and a binder, wherein the colored layer has a surface resistivity of $1\times10^{12}$Ω/□ or higher, and a color difference in a colored portion colored in a single hue in the colored layer is 5.0 or less, wherein the colored aramid paper is prepared by applying a coating liquid comprising a coloring agent, a binder, and 10 to 98 wt % of an organic solvent onto the at least one surface of the aramid paper to form the colored layer.

2. The colored aramid paper according to claim 1, wherein the colored layer is colored in a single hue or two or more hues.

3. The colored aramid paper according to claim 1, wherein the colored layer has a thickness of 0.01 to 20 μm.

4. The colored aramid paper according to claim 1, wherein the colored aramid paper has a thickness of 0.02 to 1.00 mm.

5. The colored aramid paper according to claim 1, wherein the coloring agent is an organic pigment or an inorganic pigment.

6. The colored aramid paper according to claim 1, wherein the color difference in the colored portion colored in the single hue in the colored layer is 4.0 or less.

7. A process for producing a colored aramid paper, the process comprising:

applying a coating liquid comprising a coloring agent, a binder, and 10 to 98 wt % of an organic solvent onto at least one surface of an aramid paper comprising an aramid fibrid and an aramid short fiber having a length of 1 mm to 25 mm to form a colored layer having a surface resistivity of 1×1012Ω/□ or higher and a color difference in a colored portion colored in a single hue in the colored layer of 5.0 or less.

8. The process for producing the colored aramid paper according to claim 7, wherein the content of the coloring agent in the coating liquid is 1 to 30 wt %, and the content of the binder in the coating liquid is 1 to 20 wt %.

9. The process for producing the colored aramid paper according to claim 7, wherein the organic solvent comprises at least one compound selected from the group consisting of an alcohol, an ester, an ether, a ketone and an aromatic hydrocarbon.

10. The process for producing the colored aramid paper according to claim 7, wherein the coating liquid comprises 15 to 90 wt % of the organic solvent.

11. The process for producing the colored aramid paper according to claim 7, wherein the coating liquid further comprises 0 to 10 wt % of an auxiliary agent selected from the group consisting of a dispersant, a stabilizer, an antioxidant, an antistat, a curing agent, a viscosity improver, and a wear-resistance improver.

12. The process for producing the colored aramid paper according to claim 7, wherein the coating liquid is applied onto the at least one surface of the aramid paper by a printing method or a coating method.

13. The process for producing a colored aramid paper according to claim 7, wherein the coating liquid is applied onto the at least one surface of the aramid paper by a coating method.

* * * * *